US012791223B2

(12) United States Patent
Karaki et al.

(10) Patent No.: US 12,791,223 B2
(45) Date of Patent: Nov. 10, 2026

(54) WATER HEATER

(71) Applicant: NORITZ CORPORATION, Hyogo (JP)

(72) Inventors: Tatsuya Karaki, Hyogo (JP); Tsuneo Funabiki, Hyogo (JP); Kazuma Kobayashi, Hyogo (JP); Shigeo Sugie, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 372 days.

(21) Appl. No.: 18/600,810

(22) Filed: Mar. 11, 2024

(65) Prior Publication Data

US 2024/0318868 A1 Sep. 26, 2024

(30) Foreign Application Priority Data

Mar. 22, 2023 (JP) ..... 2023-045393

(51) Int. Cl.

| | |
|---|---|
| ***F24H 9/00*** | (2022.01) |
| ***F23D 14/02*** | (2006.01) |
| ***F23D 14/14*** | (2006.01) |
| ***F23D 14/78*** | (2006.01) |
| ***F24H 1/10*** | (2022.01) |
| ***F24H 1/16*** | (2022.01) |

(Continued)

(52) U.S. Cl.

CPC ..... *F24H 9/0026* (2013.01); *F23D 14/02* (2013.01); *F23D 14/145* (2013.01); *F23D 14/78* (2013.01); *F24H 1/107* (2013.01); *F24H 1/165* (2013.01); *F24H 9/0005* (2013.01); *F24H 9/02* (2013.01); *F24H 9/06* (2013.01); *F24H 9/14* (2013.01); *F24H 9/146* (2013.01); *F24H 9/1836* (2013.01); *F24H 9/148* (2013.01)

(58) Field of Classification Search

CPC ..... F24H 9/0026; F24H 1/107; F24H 1/165; F24H 9/0005; F24H 9/02; F24H 9/06; F24H 9/14; F24H 9/146; F24H 9/1836; F24H 9/148; F23D 14/02; F23D 14/145; F23D 14/78

See application file for complete search history.

(56) References Cited

FOREIGN PATENT DOCUMENTS

| | | |
|---|---|---|
| JP | 6475092 | 2/2019 |
| JP | 6834772 | 2/2021 |

OTHER PUBLICATIONS

JP_6475092_B2 translation (Year: 2026).*
Chesterton_flange_sealing_guide_2012.pdf (Year: 2012).*

* cited by examiner

*Primary Examiner* — Michael G Hoang
*Assistant Examiner* — Kurt J Wolford
(74) *Attorney, Agent, or Firm* — JCIPRNET

(57) ABSTRACT

The invention provides a water heater WH including first and second connection target parts J1, J2 that are, as a means for connecting a burner unit BU and a heat exchanger HE, frame-like parts provided at opening edge parts of a first case 1 of the burner unit and a second case 2 of the heat exchanger, respectively, and sandwich a sealing member 5 to face and be connected with each other. An entire shape of the sealing member is frame-like corresponding to the first and second connection target parts, and a notched concave part 50 or a non-notched hole part 50A is formed at a portion thereof. A heat transfer convex part 15 is provided at at least one of the first and second connection targets, and protrudes to enter the concave part or the hole part to come into surface contact with the other.

9 Claims, 9 Drawing Sheets

(51) Int. Cl.

| | |
|---|---|
| ***F24H 9/02*** | (2006.01) |
| ***F24H 9/06*** | (2006.01) |
| ***F24H 9/14*** | (2006.01) |
| ***F24H 9/1836*** | (2022.01) |

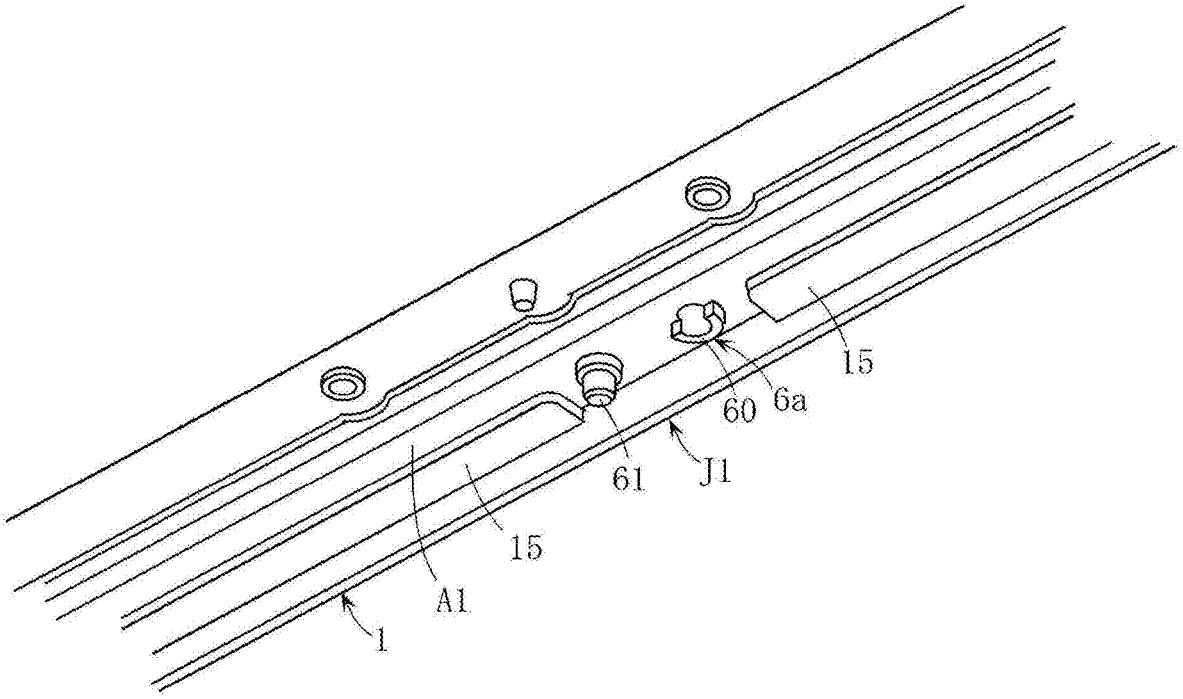
FIG. 9
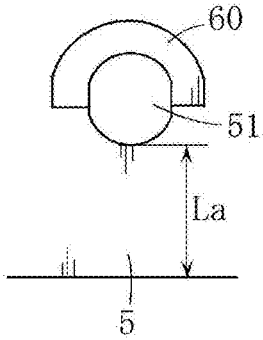
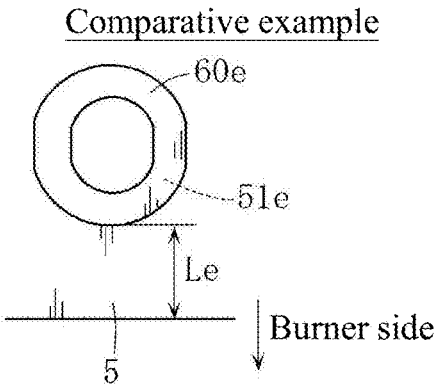
FIG. 10A FIG. 10B

WATER HEATER

CROSS-REFERENCE TO RELATED APPLICATION

This application claims the priority benefit of Japan application no. 2023-045393, filed on Mar. 22, 2023. The entirety of the above-mentioned patent application is hereby incorporated by reference herein and made a part of this specification.

BACKGROUND

Technical Field

The invention relates to a water heater, such as a hot water supply apparatus.

Description of Related Art

Patent Document 1 discloses a specific example of a water heater.

The water heater of Patent Document 1 includes a burner unit and a heat exchanger for heating hot water and water. The burner unit includes a burner and a first case (burner body or burner case). The first case is installed to the burner, and fuel gas is supplied into the first case. The heat exchanger includes a second case and a heat transfer tube. Combustion gas generated by the burner travels in the second case. The heat transfer tube is provided in the second case, recovers heat from the combustion gas, and heats hot water and water.

As a means for connecting the first case of the burner unit and the second case of the heat exchanger, a flange part in a frame shape when viewed in a plan view is provided at the upper end of the second case. In addition, a frame-like region corresponding to the flange part is provided at the lower part of the first case. The portions sandwich a sealing member (rubber seal), and are connected with each other by using a fastening member, such as a threaded body.

With such configuration, it is possible to improve the seal performance of the connection position of the first and second cases and prevent the combustion gas from leaking out from the connection position.

However, according to the conventional technique, there is still room for improvement as described in the following.

That is, at the time when the burner is driven for combustion, due to the influence of the combustion gas, the first case of the burner unit may become hot. Conventionally, a fan supplying fuel gas, a valve mechanism for preventing the combustion gas from flowing back, and other devices, for example, are installed to the first case. Therefore, when the first case becomes hot, such devices may suffer from thermal damages.

As a means for prevention, according to the disclosure of Patent Document 2, for example, there is a means for disposing the burner in the second case of the heat exchanger and bringing an outer periphery flange part provided in the burner into contact with the periphery wall part of the second case. According to such means, the heat of the burner is eventually transmitted to the heat transfer tube and escapes via the periphery wall part of the second case from the outer periphery flange part, the temperature of the first case is prevented from rising, and the above issue can be eliminated.

According to such means, the burner provided with the outer periphery flange part is assembled inside the second case of the heat exchanger. Therefore, the overall size may easily increase, and the manufacturing cost may easily increase.

PRIOR ART DOCUMENT(S)

Patent Document(s)

[Patent Document 1] Japanese Patent No. 6475092

[Patent Document 2] Japanese Patent No. 6834772

The invention provides a water heater able to improve the seal performance of the connection position between the first case of the burner unit and the second case of the heat exchanger while preventing the overall size from increasing or the configuration from becoming complicated, and suitably preventing the temperature of the first case from increasing.

SUMMARY

A water heater according to an aspect of the disclosure provides a water heater. The water heater includes: a burner unit, having a first case and a burner, wherein a fuel gas is supplied into the first case, and the burner is installed to the first case and combusts the fuel gas; a heat exchanger, having a second case and a heat transfer tube, wherein a combustion gas generated by the burner travels in the second case, and the heat transfer tube recovers heat from the combustion gas; and a first connection target part and a second connection target part, being frame-like parts provided at respective opening edge parts of the first case and the second case, and sandwiching a sealing member to face and be connected with each other. An overall shape of the sealing member is in a frame shape corresponding to the first connection target part and the second connection target part, and a concave part that is notched or a hole part that is non-notched is formed at a portion of the sealing member, and a heat transfer convex part is provided in at least one of the first connection target part and the second connection target part, protrudes to enter the concave part or the hole part to be brought into surface contact with an other of the first connection target part and the second connection target part, and generates heat transfer between the first connection target part and the second connection target part.

BRIEF DESCRIPTION OF THE DRAWINGS

FIG. 9 is an enlarged perspective view of an IX part of FIG. 8.

FIG. 10A is a schematic view illustrating a guide part shown in FIG. 9, and FIG. 10B is a schematic view illustrating a comparative example of FIG. 10A.

DESCRIPTION OF THE EMBODIMENTS

Figure 1:
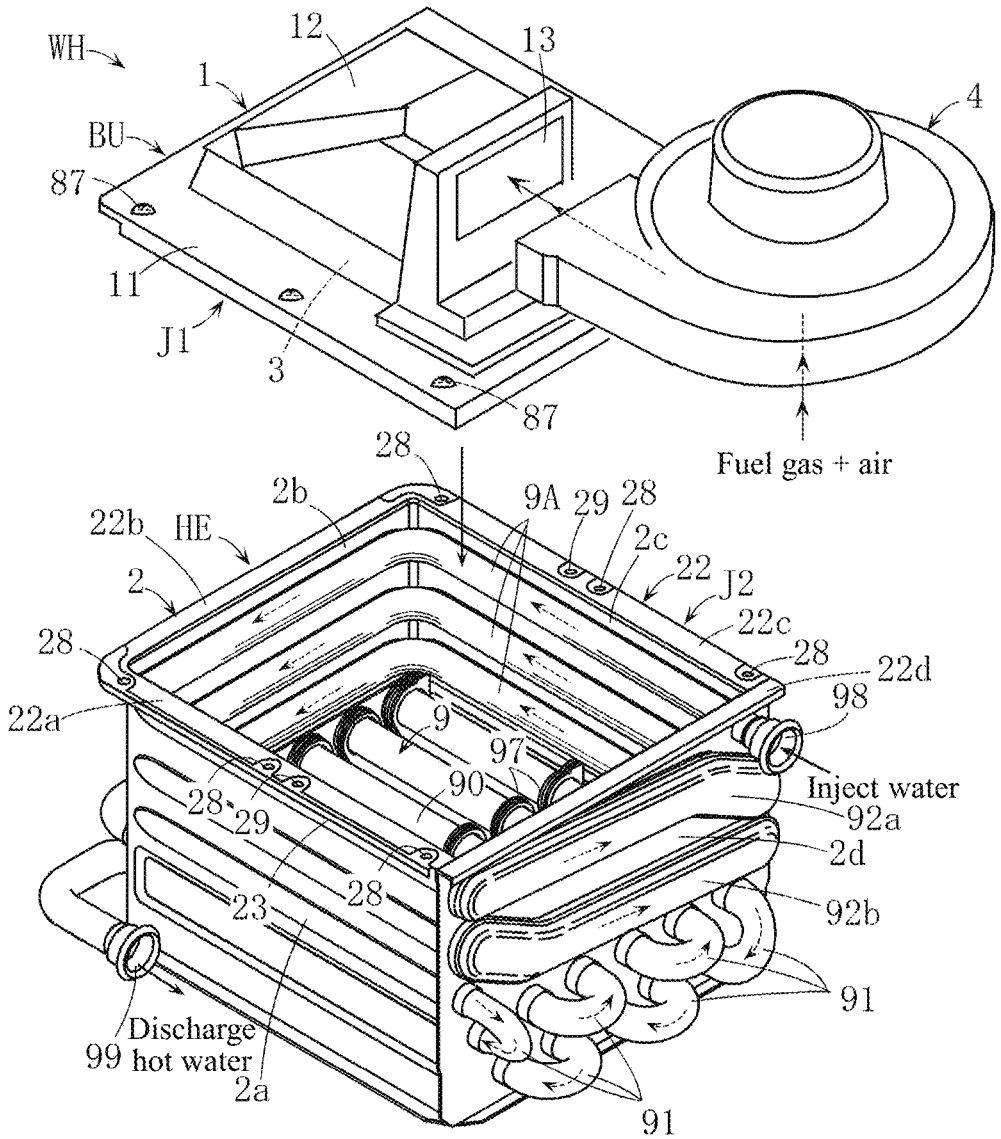
FIG. 1 is an exploded perspective view of a water heater according to the invention.

A water heater according to an aspect of the disclosure provides a water heater. The water heater includes: a burner unit, having a first case and a burner, wherein a fuel gas is supplied into the first case, and the burner is installed to the first case and combusts the fuel gas; a heat exchanger, having a second case and a heat transfer tube, wherein a combustion gas generated by the burner travels in the second case, and the heat transfer tube recovers heat from the combustion gas; and a first connection target part and a second connection target part, being frame-like parts provided at respective opening edge parts of the first case and the second case, and sandwiching a sealing member to face and be connected with each other. An overall shape of the sealing member is in a frame shape corresponding to the first connection target part and the second connection target part, and a concave part that is notched or a hole part that is non-notched is formed at a portion of the sealing member, and a heat transfer convex part is provided in at least one of the first connection target part and the second connection target part, protrudes to enter the concave part or the hole part to be brought into surface contact with an other of the first connection target part and the second connection target part, and generates heat transfer between the first connection target part and the second connection target part.

According to the configuration, effects as follows are attained.

That is, it is configured that the frame-like first connection target part provided in the first case of the burner unit and the frame-like second connection target part provided in the second case of the heat exchanger sandwich the sealing member to face and be connected with each other. Therefore, the seal performance of the connection position of the first and second cases is favorable, and the concern that the combustion gas leaks out from the connection position can be eliminated.

Meanwhile, between the first and second connection target parts, heat can be transferred via the heat transfer convex part. Therefore, when the burner is driven for combustion and the first case receives the heat from the combustion gas, the heat can effectively escape via the heat transfer convex part from the first case toward the second case. Therefore, the temperature of the first case is prevented from increasing, and the concern that the apparatuses disposed to be affiliated with the first case suffer from thermal damages can be eliminated or reduced.

In addition, according to the invention, the notched concave part or the non-notched hole part is formed at the frame-like sealing member, and the heat transfer convex part enters the concave part or the hole part. Therefore, the overall size of the sealing member and the heat transfer convex part does not become bulky, the overall size of the water heater can be reasonably reduced, and the configuration of the water heater can be reasonably simplified.

If, differing from the invention, the heat transfer convex part is simply arranged on the outer side of the sealing member without providing the concave part or the hole part in the sealing member, the total width of these components increases, and, as a result, the first and second connection target parts also become wide. Comparatively, according to the invention, it is possible to properly avoid such issue.

According to an embodiment of the invention, it may also be configured that the heat transfer convex part is in a block shape or a rib shape extending in a same direction as the first connection target part and the second connection target part.

According to the configuration, at the position where the heat transfer convex part is provided, the width of the sealing member is prevented from being excessively narrow, while the size (length) of the heat transfer convex part can increase, and the heat transfer area between the first and second connection target parts can increase.

According to an embodiment of the invention, it may also be configured that the water heater includes: as the heat transfer convex part, multiple heat transfer convex parts arranged at intervals in a direction in which the first connection target part and the second connection target part extend. A fastening part fastening the first connection target part and the second connection target part by using a fastening member is provided at a position between the heat transfer convex parts.

According to the configuration, effects as follows are attained.

That is, at the positions between the heat transfer convex parts, the fastening part fastening the first and second connection target parts is provided. Thus, the fastening force due to the fastening part can be applied to both of the heat transfer convex parts located on the two sides of the fastening part. Accordingly, the heat transfer convex parts are brought into proper surface contact with respect to one of the first and second connection target parts, and it is difficult to generate a large gap therebetween. Therefore, the heat transfer properties between the first and second connection target parts are favorable, and the temperature of the first case can be further prevented from increasing.

According to an embodiment of the invention, it may also be configured that the concave part or the hole part of the sealing member is formed on an outer edge or a portion near the outer edge of the sealing member, and the heat transfer convex part is located at a region near an outer side, which is a side away from the burner, in a region between the first connection target part and the second connection target part, and a portion of the sealing member is present on an inner side of the heat transfer convex part.

According to the configuration, the heat transfer convex part is disposed to be away from the burner. In addition, a portion of the sealing member present on the inner side of the heat transfer convex part exerts an effect of making it difficult for the combustion gas and radiation heat to directly act on the heat transfer convex part from the burner side. Therefore, the heat transfer convex part itself is properly prevented from becoming hot through direct heating. As a result, the heat transfer convex part can effectively function as a portion (cooling function part) for preventing the temperature of the first case from increasing.

According to an embodiment of the invention, it may also be configured that the water heater further includes: an additional hole part, provided at the scaling member; and a guide part for a fastening member, wherein the guide part is protrusively provided at one of the first connection target part and the second connection target part to enter the additional hole part, and the fastening member fastening the first connection target part and the second connection target part is inserted on an inner side. The guide part is in a half-split tubular shape in which a single side portion on a side near the burner is notched.

According to the configuration, in addition to serving as an insertion guide of the fastening member, the guide part can also serve as a spacer that can set the mutual dimension between the first and second connection target parts, the compression margin of the sealing member, etc., to desired dimensions.

Moreover, the guide part is in a half-split tubular shape in which a single side portion that is a side near the burner is notched. Therefore, compared with the case where the guide part is in a tubular shape, for example, which is different from the above, the distance from the burner to the guide part can increase. This indicates that the additional hole part of the sealing member into which the guide part enters is set to be small-sized, and the width of the sealing member close to the burner side with respect to the guide part can increase. Therefore, regarding the periphery part provided with the guide part, it is possible to improve seal properties by using the sealing member.

According to an embodiment of the invention, it may also be configured that the burner is installed to the first case by using multiple additional fastening members at a position on the inner side of the first connection target part in the first case, and at least a portion of an inner edge part of the sealing member is configured as an extension part protruding toward an inner side thereof from the first connection target part and the second connection target part and covering at least one of the additional fastening members.

According to the configuration, among the additional fastening members, those covered by the extension part of the sealing member hardly directly receive combustion gas or radiation heat. Therefore, the temperature of the additional fastening member can be prevented from increasing and the increase in temperature of the first case itself that comes along with the increase in temperature of the additional fastening member can be prevented.

The configuration in which the additional fastening member is covered by the sealing member is realized by causing at least a portion of the inner edge part of the scaling member to protrude inwardly from the first and second connection target parts. Therefore, the configuration is reasonable and easy to manufacture.

Other features and advantages of the invention will become more apparent from the following description of embodiments of the invention with reference to the accompanying drawings.

In the following, the exemplary embodiments of the invention are described in detail with reference to the drawings.

Figure 2:
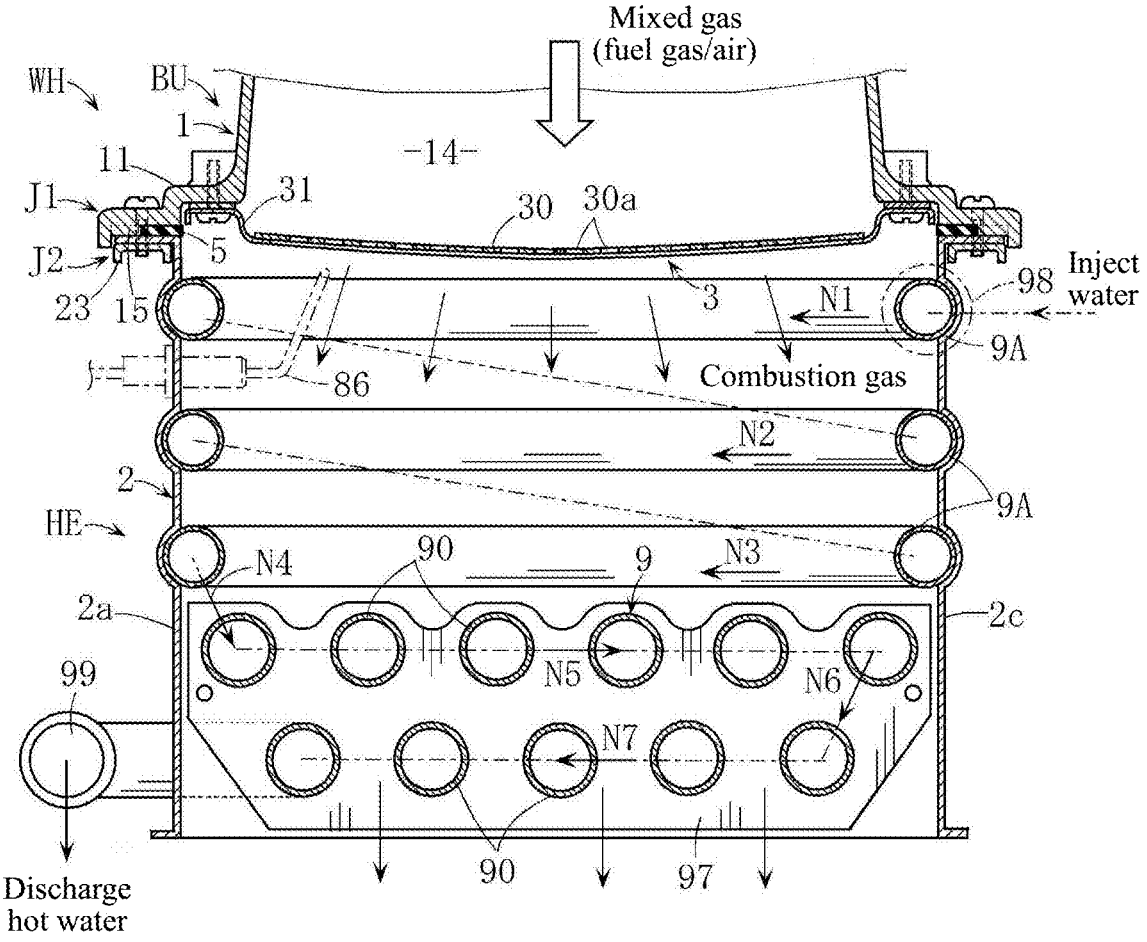
FIG. 2 is a cross-sectional view illustrating main parts in an assembled state of the water heater shown in FIG. 1.

A water heater WH shown in FIGS. 1 and 2 is formed as a hot water supply apparatus, and includes a fan 4 (omitted in FIG. 2), a burner unit BU, and a heat exchanger HE.

The burner unit BU includes a burner 3 and a first case 1 as a burner body case to which the burner 3 is installed. The first case 1 is a cast product, such as an aluminum die-cast. An upwardly convex wall part 12 is provided on the upper surface part of a frame-like base part 11, and a fuel gas supply port 13 is formed on the upwardly convex wall part 12. A chamber 14 open at the lower part in communication with the fuel gas supply port 13 is formed in the first case 1. A first connection target part J1 and multiple heat transfer convex parts 15 are provided in the first case 1.

The fan 4 is installed to the upper part of the first case 1, and supplies fuel gas in a mixed gas state in which fuel gas and air are mixed (pre-mixed gas) from the fuel gas supply port 13 to the chamber 14.

The burner 3 includes a porous combustion plate 30 and a burner frame body 31. The combustion plate 30 has multiple ventilation holes 30*a* (flame holes). The burner frame body 31 supports the combustion plate 30. The burner 3 is installed to the first case 1, so that the combustion plate 30 blocks the lower opening part of the chamber 14. The installation is carried out by installing the burner frame body 31 to the lower surface part of the first case 1 by using multiple screws 88 (equivalent to a specific example of "additional fastening member" in the invention), for example. At the position of installation, a sealing rubber seal 96 with excellent heat resistance is interposed between the burner frame body 31 and the first case 1.

In the chamber 14, the mixed gas travels downward, and passes downward through the ventilation holes 30*a* of the combustion plate 30 of the burner 3. The mixed gas is ignited by using an ignition plug 86. Accordingly, the front surface side (lower surface side) of the combustion plate 30 becomes a combustion region of the fuel gas. The combustion gas generated through such combustion travels downward, and enters the second case 2 (to be described afterwards) of the heat exchanger HE.

The heat exchanger HE is connected to the lower side of the burner unit BU, recovers heat from the combustion gas generated by the burner 3 and traveling downward, and heats hot water and water. The heat exchanger HE includes multiple body pipes 9A arranged vertically at intervals and a heat transfer tube 9, in addition to the second case 2. The second case 2 is in a tubular shape having a substantially rectangular shape when viewed in a plan view having multiple sidewall parts 2*a* to 2*d* surrounding the combustion region on the lower surface side of the burner B and the lower region thereof.

The body pipes 9A are in a substantially C shape when viewed in a plan view that extends in a substantially horizontal direction along the inner surface side of the sidewall parts 2*a* to 2*c*, and are connected in series via header flow paths 92*a*, 92*b* provided on the sidewall part 2*d*. Like the heat transfer tube 9, the body pipes 9A are included in the heat transfer tube of the invention. The heat transfer tube 9 is configured so that multiple straight tube parts 90 bonded to multiple fins 97 for heat recovery and extending in the horizontal direction are connected in series via substantially U-shaped bent tubes 91 on the outside of the second case 2.

In the heat exchanger HE, hot water and water are supplied from a water inlet 98 to the body pipe 9A at the uppermost stage. Then, the hot water and water flow to the lower stage side as indicated by arrow signs N1 to N3 of FIG. 2 through the body pipes 9A in vertical stages via the header flow paths 92*a*, 92*b*. Then, the hot water and water flow through the heat transfer tube 9 (the straight pipe parts 90 and the bent pipes 91) in the order of arrow signs N4 to N7, and arrive at a hot water outlet 99. In such process, the hot water and water are heated by the combustion gas and supplied to a desired hot water supply destination from the hot water outlet 99. In addition, although the body pipe 9A exerts an effect of cooling the second case 2, such effect may facilitate heat transfer from the first case 1 to the second case 2, and prevent the temperature of the first case 1 from increasing.

The first case 1 and the second case 2 are connected by using the first connection target part J1 and a second connection target part J2. The first connection target part J1 and the second connection target part J2 are frame-like when viewed in a plan view (or in a bottom view, the same applies in the following), and sandwich the seal member 5 to face each other and are connected. In the following, the configuration of the portions is described in detail.

Figure 3:
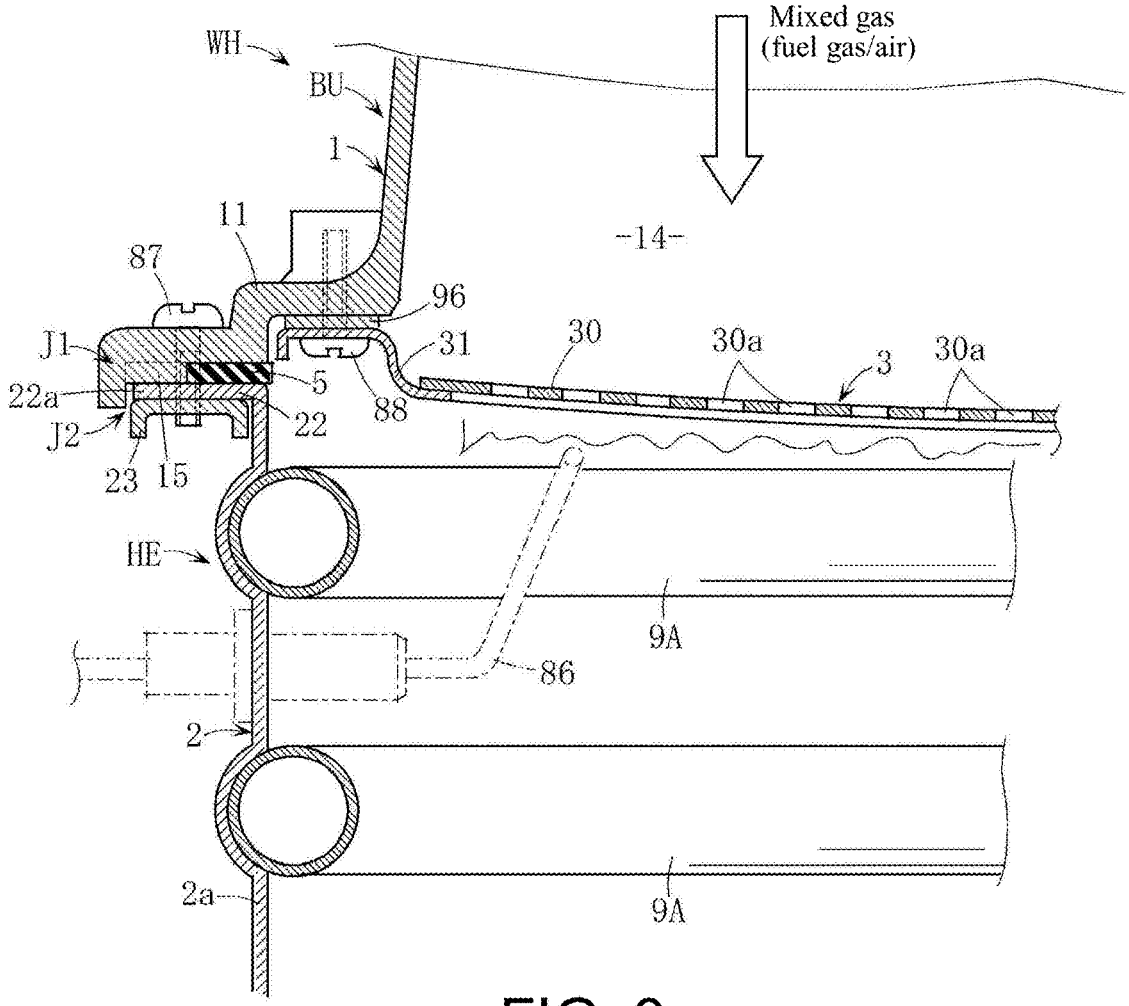
FIG. 3 is an enlarged cross-sectional view illustrating the main parts of FIG. 2.
Figure 4:
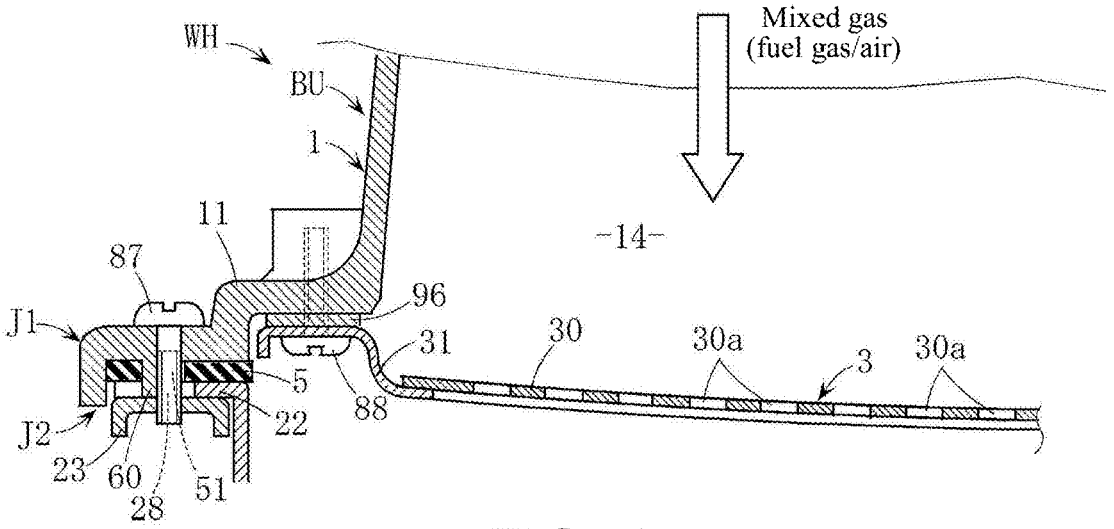
FIG. 4 is an enlarged cross-sectional view of the main parts at a cross-sectional position different from FIG. 3 in the water heater shown in FIG. 2.

That is, as clearly shown in FIG. 1, the second connection target part J2 is in a frame shape provided on the opening edge part on the upper side of the second case 2. Specifically, the second connection target part J2 is formed by including a flange part 22 having a rectangular frame shape when viewed in a plan view and connected to the upper end of the second case 2. The flange part 22 is formed by assembling four flange body parts 22*a* to 22*d* and an auxiliary member 23. The flange body parts 22*a* to 22*d* are formed by bending the upper ends of the sidewall parts 2*a* to 2*d* of the second case 2, and the auxiliary member 23 is bonded by being welded to the lower surface side of the four flange body parts 22*a* to 22*d*. As shown in FIGS. 2 to 4, the cross-section of the auxiliary member 23 is in a substantially C shape, for example. In addition, the auxiliary member 23 is divided into multiple portions in an L shape, a C shape or a straight shape when viewed in a plan view, and these portions are assembled. Accordingly, the entirety of the auxiliary member 23 is set in a rectangular frame shape when viewed in a plan view that is located on the lower surface side of each of the four flange parts 22*a* to 22*d*.

The first connection target part J1 is in a frame shape provided on the opening edge part on the lower side of the chamber 14 of the first case 1. More specifically, the first connection target part J1 is a frame-shaped portion facing the second connection target part J2 among the base part 11 of the first case 1, and is equivalent to the outer edge part of the base part 11.

Figure 5:
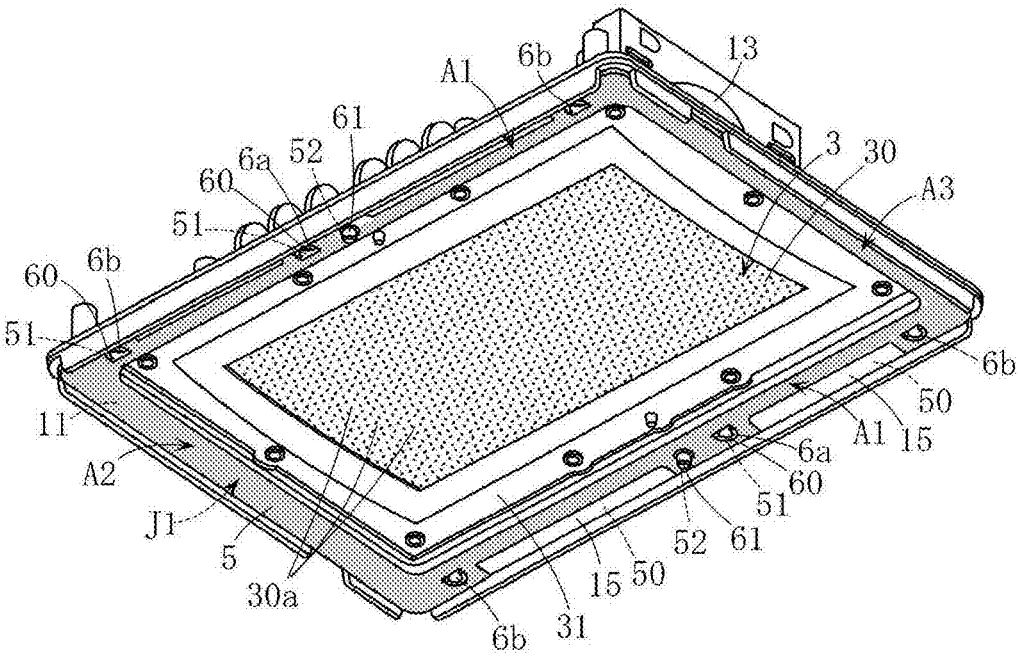
FIG. 5 is a schematic perspective view from a lower side of a burner unit of the water heater shown in FIGS. 1 and 2.
Figure 6:
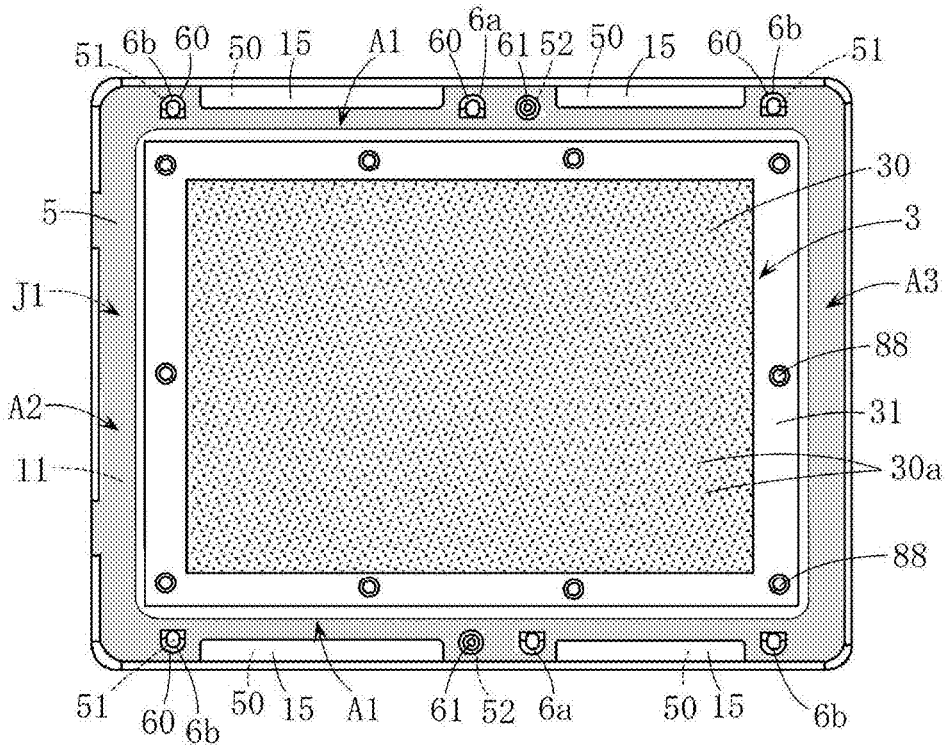
FIG. 6 is a bottom view of the burner unit shown in FIG. 5.
Figure 7:
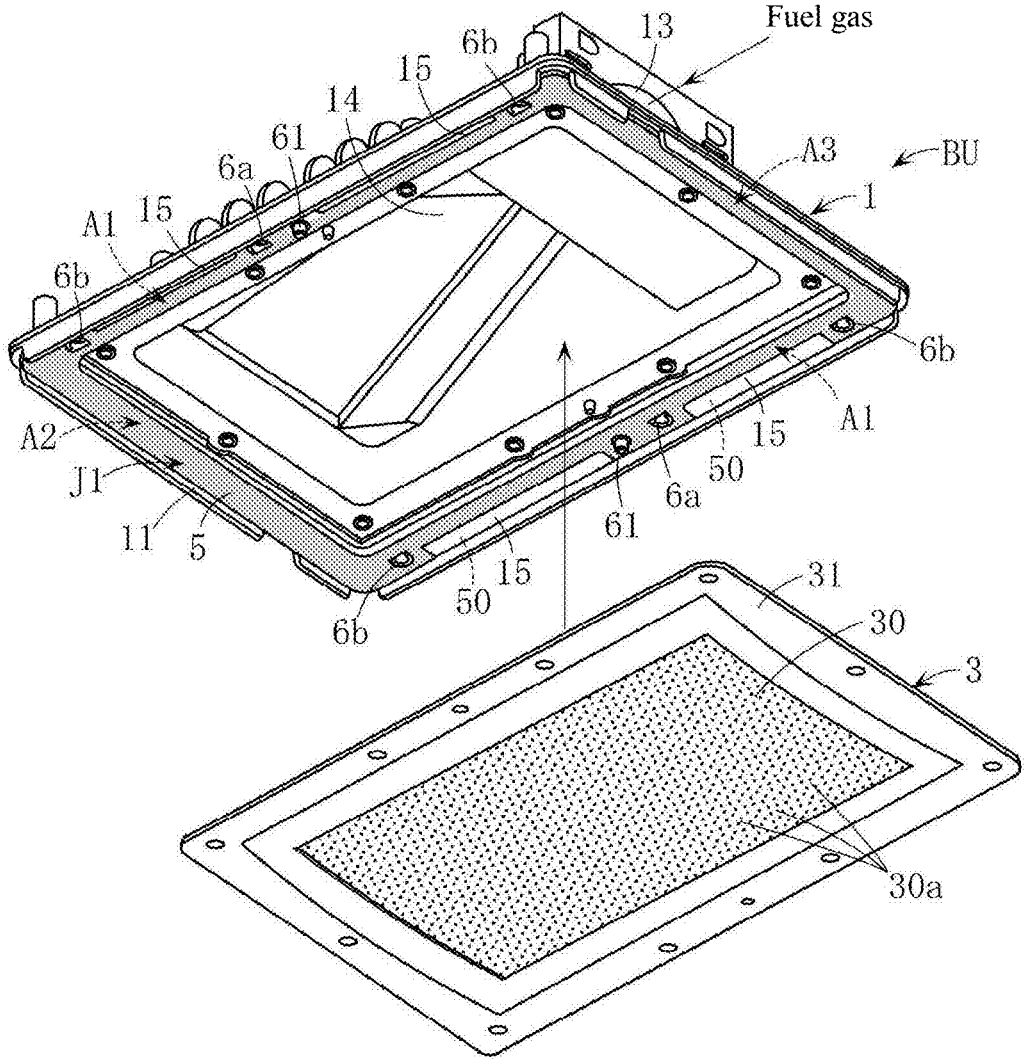
FIG. 7 is an exploded perspective view of the burner unit shown in FIG. 5.
Figure 8:
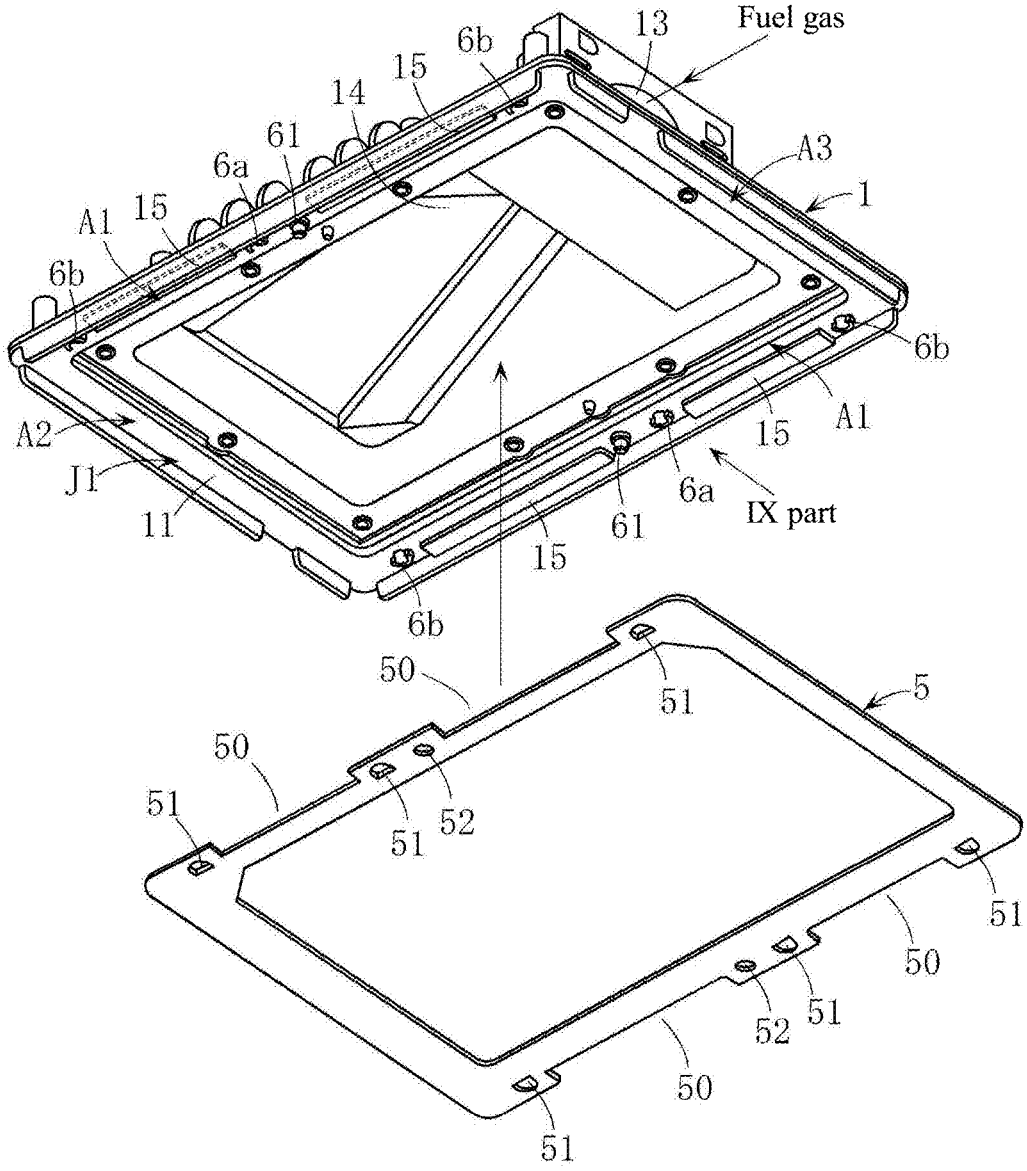
FIG. 8 is an exploded perspective view illustrating a first case and a sealing member of FIG. 7.

The sealing member 5 is a rubber seal having excellent heat resistance, like the sealing rubber seal 96. As clearly shown in FIGS. 5 to 8, the sealing member 5 (in FIGS. 5 to 7, the scaling member 5 is labeled with light ink) is in a frame shape corresponding to the first connection target part J1 and the second connection target part J2. However, it may also be that the sealing member 5 is not formed as a single member, but may be configured so that a component divided into multiple parts are set in a frame shape as a whole.

The first connection target part J1 has a pair of straight regions A1 on the front side and the rear side and straight regions A2, A3 on the left and right sides. The same applies to the second connection target part J2. When viewed in a plan view, in a similar manner, multiple notched concave parts 50 are provided at the outer edge part at positions corresponding to the pair of linear regions A1 among the sealing member 5.

Meanwhile, multiple heat transfer convex parts 15 protruding downward are protrusively provided on the first connection target part J1. The heat transfer convex parts 15 are parts that cause heat transfer between the first connection target part J1 and the second connection target part J2, and prevent the temperature of the first case 1 from increasing. The heat transfer convex parts 15 are in a block shape or a rib shape extending in the longitudinal direction of the straight region A1, and tip end surfaces (lower end surfaces) of the heat transfer convex parts 15 are planar. In addition, the heat transfer convex parts 15 enter the notched concave parts 50, and the tip end surfaces of the heat transfer convex parts 15 face and come into contact with the second connection target part J2 (see FIGS. 2 and 3).

In the embodiment, the combustion gas generated when the burner 3 is driven for combustion spreads more easily in the front-rear direction than in the left-right direction of the burner 3, and, among the first connection target part J1, the pair of straight regions A1 are easier to become hot than the straight regions A2, A3. Accordingly, the heat transfer convex parts 15 are provided at the pair of straight regions A1. It goes without saying that the heat transfer convex parts 15 can also be provided in other straight regions A2, A3.

In each of the pair of straight regions A1, the heat transfer convex parts 15 are arranged at appropriate intervals in the longitudinal direction of the straight region A1. Comparatively, at positions between the heat transfer convex parts 15, fastening parts 6*a* for fastening the first connection target part J1 and the second connection target part J2 by using screws 87 (equivalent to a specific example of "fastening member" of the invention) and positioning pins 61 are provided. In addition, at positions on the left and right sides of the heat transfer convex parts 15, fastening parts 6*b* having the same configuration as the fastening part 6*a* are further provided.

The fastening parts 6*a*, 6*b* have guide parts 60 for the fastening members. The guide part 60 protrudes downward from the first connection target part J1. The guide part 60 (see also FIG. 9) is in a half-split tubular shape, such as a half-split cylindrical shape, in which a single side portion (a portion near the center of the burner unit BU) on the side near the burner 3 is notched. The first connection target part J1 and the second connection target part J2 are connection-fixed through fastening of the screw 87 in the state in which the screw 87 is inserted on the inner side of the guide part 60. The guide part 60 enters a hole part 51 (equivalent to a specific example of "additional hole part" of the invention) having a small size and provided at the sealing member 5. As shown in FIG. 4, the tip end of the guide part 60 abuts against the second connection target part J2. Therefore, at the time of fastening the screw 87, the guide part 60 serves as a spacer for defining a tightening margin (equivalent to a compression margin of the sealing member 5) at the time of fastening the screw 87.

The positioning pin 61 protrudes downward from the first connection target part J1, and is inserted into a hole part 52 provided separately in the sealing member 5. In FIG. 1, a symbol 29 indicates a positioning hole part into which the positioning pin 61 is inserted, and a symbol 28 indicates a threaded hole part into which the screw 87 is screwed.

In the following, the effect of the water heater WH is described.

Although the first case 1 of the burner unit BU and the second case 2 of the heat exchanger HE are connected via the first connection target part J1 and the second connection target part J2, the frame-like sealing member 5 is interposed therebetween. Therefore, favorable seal performance is attained, and it is possible to eliminate the concern that the combustion gas leaks out from the connection position of the first connection target part J1 and the second connection target part J2.

Meanwhile, it is possible to transfer heat from the first case 1 to the side of the second case 2 by using the heat transfer convex parts 15. In the second case 2, since the cooling effect exerted by the hot water and water flowing through the body pipe 9A and the heat transfer tube 9 can be expected, such heat transfer is possible. Accordingly, even if the burner 3 is driven for combustion and the first case 1 receives heat from the combustion region of the burner 3, with such heat escaping from the side of the first case 1 to the side of the second case 2, the temperature of the first case 1 can be suppressed from increasing. Therefore, for example, the fan 4 as well as other devices (not shown) installed to the first case 1 can be prevented from suffering from thermal damages.

In the embodiment, the notched concave part 50 is formed at the outer edge part of the sealing member 5, and the heat transfer convex part 15 enters the notched convex part 50. Therefore, compared with the case where the notched convex parts 50 are not provided in the sealing member 5, for example, and only the heat transfer convex parts 15 and the sealing member 5 are provided and arranged, the overall width can be reduced according to the embodiment. This helps reduce the sizes of the first connection target part J1 and the second connection target part J2 and helps reduce the sizes of both of the first case 1 and the second case 2.

In addition, the heat transfer convex parts 15 are in a block shape or a rib shape extending in the longitudinal directions of the straight regions A1 of the first connection target part J1 and the second connection target part J2. Therefore, the size of each of the heat transfer convex parts 15 may be further increased without excessively reducing the width of the sealing member 5 at the positions where the heat transfer convex parts 15. When the size of each of the heat transfer convex parts 15 is increased to increase the heat transfer area between the first connection target part J1 and the second connection target part J2, the temperature of the first case 1 can be further prevented from increasing.

The notched convex parts 50 are formed at the outer edge part of the sealing member 5, and the heat transfer convex parts 15 are located at regions near the outer side, which is a side away from the burner 3, in the region between the first connection target part J1 and the second connection target part J2. In addition, a portion of the sealing member 5 is present on the inner side of the heat transfer convex part. Such portion also exerts an effect of blocking the combustion gas traveling from the side of the burner 3 or radiation heat from reaching the heat transfer convex part 15. As a result, the heat transfer convex part 15 itself is appropriately prevented from directly receiving heat and becoming hot, and the heat transfer convex part 15 can effectively function as a portion for preventing the temperature of the first case 1 from increasing.

Although the first connection target part J1 and the second connection target part J2 are fastened to each other by the fastening parts 6*a*, 6*b*, the fastening part 6*a* is located between multiple (two) heat transfer convex parts 15. Therefore, the fastening force of the fastening part 6*a* is applied to both of the heat transfer convex parts 15, and the tip end surfaces thereof can be reliably brought into surface contact with the second connection target part J2. In addition, the fastening parts 6*b* are provided on the left and right sides of the heat transfer convex parts 15. Therefore, it is possible to more appropriately bring the heat transfer convex parts 15 into surface contact with the second connection target part J2.

As described above, the guide part 60 into which the screw 87 is inserted serves as a spacer for defining the fastening margin (equivalent to the compression margin of the scaling member 5) at the time of fastening the screw 87, and the guide part 60 is in a half-split tubular shape as shown in FIG. 9, etc. Accordingly, the distance from the burner 3 to the guide part 60 increases, and it is possible to ensure the width of the sealing member 5.

More specifically, FIG. 10B illustrates a comparative example of the embodiment. A guide part 60*e* of the comparative example is in a tubular shape. Therefore, the shape and the size of a hole part 51*e* which is provided at the sealing member 5 and into which the guide part 60*e* is inserted also vary correspondingly, and a distance Le from an end of the sealing member 5 to the hole part 51*e* decreases. As a result, the seal properties of the periphery part of the guide part 60*e* may deteriorate.

Comparatively, as shown in FIG. 10A, according to the embodiment, the size of the hole part 51 of the sealing member 5 into which the guide part 60 is inserted is reduced, a distance La from an end of the sealing member 5 to the hole part 51 can be longer than the distance Le in the comparative example. Therefore, the seal properties of the periphery part of the guide part 60 may be prevented from deteriorating.

Figure 11A:
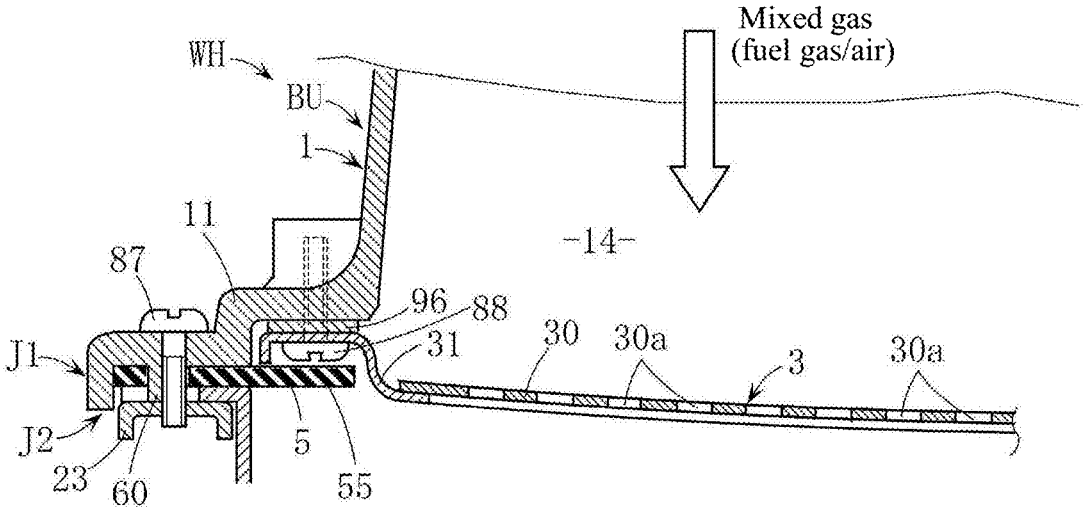
FIG. 11A is an enlarged cross-sectional view illustrating main parts of another example of the invention.
Figure 11B:
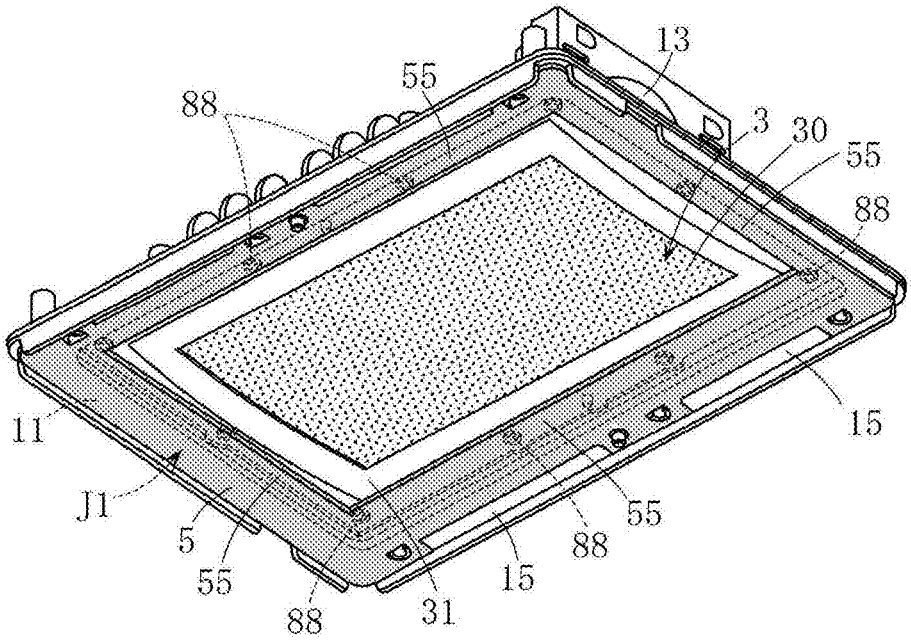
FIG. 11B is a schematic perspective view illustrating the burner unit including a configuration equivalent to FIG. 11A.
Figure 12:
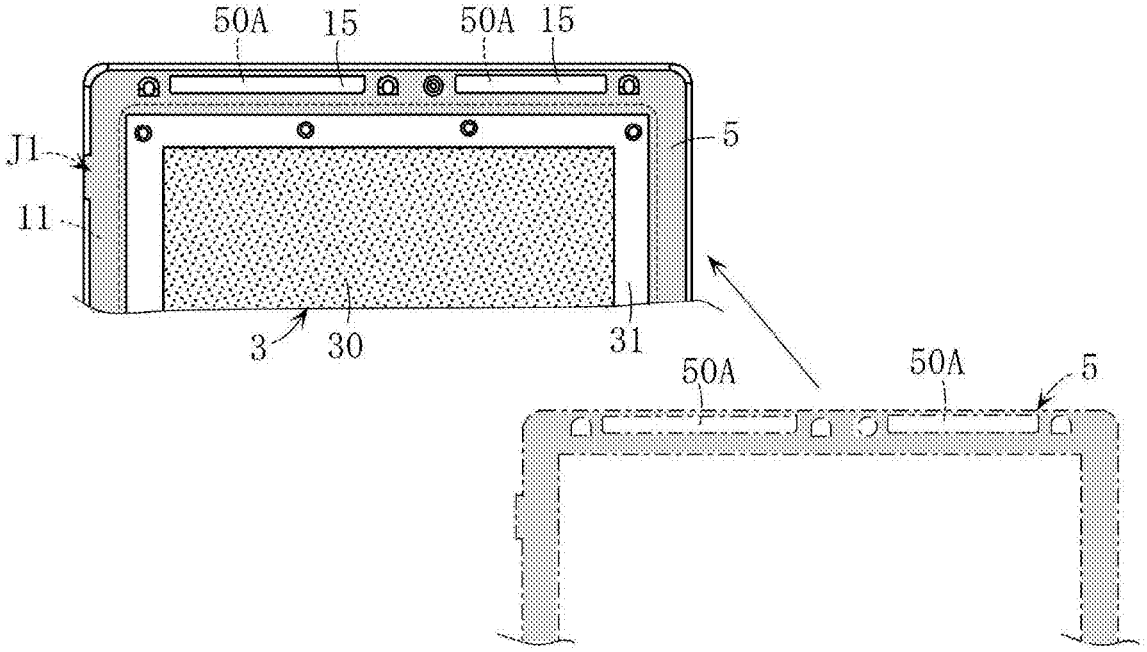
FIG. 12 is a bottom view illustrating main parts of another example of the invention.

FIGS. 11A, 11B, and 12 illustrate other embodiments of the invention. In this drawings, components like or similar to those of the above embodiment are labeled with reference symbols same as the above embodiment, and the repeated description is omitted.

In the embodiment shown in FIGS. 11A and 11B, portions of the inner edge part of the scaling member 5 are extensively provided from between the first connection target part J1 and the second connection target part J2 to protrude toward the side of the burner 3, and serve as extension parts 55 to cover the screws 88. The extension part 55*s*, as shown in FIG. 11B, are provided at the respective four linear inner edge parts of the sealing member 5, and all of the screws 88 for installing the burner 3 are covered by the extension parts 55.

According to the embodiment, it is difficult for the screws 88 for installing the burner 3 to directly receive the combustion gas or radiation heat. Therefore, the temperature of the screws 88 is prevented from increasing, and the increase in the temperature of the first case 1 that comes together with the increase in the temperature of the screws 88 can be prevented. The configuration in which the extension parts 55 are provided in the sealing member 5 is simple, and the number of components does not increase. Therefore, the manufacturing cost can be prevented from increasing.

Also, differing from the embodiment, it is also possible to provide the extension part 55 only at one position, for example, and cover only some of the screws 88.

In the embodiment shown in FIG. 12, non-notched hole parts 50A are provided at the sealing member 5. The heat transfer convex parts 15 enter the hole parts 50A.

As shown in the embodiment, in the invention, it is possible to provide the non-notched hole parts 50A in place of providing the notched convex parts 50 in the sealing member 5. In such case as well, the same effect as the above embodiment is expected.

The invention is not limited to the above embodiment. The specific configuration of the respective parts of the water heater according to the invention can be designed and modified in various ways within the claimed scope of the invention.

In the embodiment, the heat transfer convex parts 15 are provided at the first connection target part J1. However, in place thereof or in addition thereto, it is also possible to configure the heat transfer convex parts 15 at the second connection target part J2.

The heat transfer convex part 15 may be configured as a stepped part, for example, and it is possible to set the specific shape thereof in various shapes other than a block shape or a rib shape extending in a predetermined direction. The specific number or the specific position of the heat transfer convex part can be changed in various ways.

It suffices as long as the first connection target part and the second connection target part of the invention are frame-like parts provided at the respective opening edge parts of the first case of the burner unit and the second case of the heat exchanger and parts that sandwich the sealing member to face and be connected with each other, and it is not required for the first connection target part and the second connection target part to be configured as flange parts. As the fastening member fastening the first connection target part and the second connection target part, threaded members other than screws may also be used.

The specific material of the sealing member is not particularly limited, either. Although the sealing member is in a frame shape (loop shape), as described above, a component in which multiple components are connected in a frame shape may also be adopted.

Although the water heater WH of the embodiment is of a reverse combustion type in which the fuel gas or the combustion gas travels downward. The invention is not limited thereto. For example, an apparatus may also be arranged upside down with respect to the above embodiment, and a forward combustion type in which the fuel gas travels upward from the burner unit toward the heat exchanger can be arranged. The specific configuration of the heat exchanger or each part of the burner unit forming the water heater is not limited to the contents of the above embodiment.

In addition to a hot water supply apparatus capable of general hot water supply, bath hot water supply, or room-heating hot water supply, the concept of the water heater according to the invention also covers other apparatuses having a hot water generating function.

What is claimed is:

1. A water heater, comprising:

a burner unit, having a first case and a burner, wherein a fuel gas is supplied into the first case, and the burner is installed to the first case and combusts the fuel gas;

a heat exchanger, having a second case and a heat transfer tube, wherein a combustion gas generated by the burner travels in the second case, and the heat transfer tube recovers heat from the combustion gas; and a first connection target part and a second connection target part, being frame-like parts provided at respective opening edge parts of the first case and the second case, and sandwiching a sealing member to face and be connected with each other, wherein an overall shape of the sealing member is in a frame shape corresponding to the first connection target part and the second connection target part, and a concave part that is notched or a hole part that is non-notched is formed at a portion of the sealing member, and a heat transfer convex part is provided in at least one of the first connection target part and the second connection target part, protrudes to enter the concave part or the hole part to be brought into surface contact with an other of the first connection target part and the second connection target part, and generates heat transfer between the first connection target part and the second connection target part, wherein the water heater further comprises:

an additional hole part, provided at the sealing member; and a guide part for a fastening member, wherein the guide part is protrusively provided at one of the first connection target part and the second connection target part to enter the additional hole part, and the fastening member fastening the first connection target part and the second connection target part is inserted on an inner side, wherein the guide part is in a half-split tubular shape in which a single side portion on a side near the burner is notched.

2. The water heater as claimed in claim 1, wherein the heat transfer convex part is in a block shape or a rib shape extending in a same direction as the first connection target part and the second connection target part.

3. The water heater as claimed in claim 2, comprising: as the heat transfer convex part, a plurality of heat transfer convex parts arranged at intervals in a direction in which the first connection target part and the second connection target part extend, wherein a fastening part fastening the first connection target part and the second connection target part by using a fastening member is provided at a position between the heat transfer convex parts.

4. The water heater as claimed in claim 1, wherein the concave part or the hole part of the sealing member is formed on an outer edge of the sealing member or a portion near the outer edge, and the heat transfer convex part is located at a region near an outer side, which is a side away from the burner, in a region between the first connection target part and the second connection target part, and a portion of the sealing member is present on an inner side of the heat transfer convex part.

5. The water heater as claimed in claim 1, wherein the burner is installed to the first case by using a plurality of additional fastening members at a position on the inner side of the first connection target part in the first case, and at least a portion of an inner edge part of the sealing member is configured as an extension part protruding toward an inner side thereof from the first connection target part and the second connection target part and covering at least one of the additional fastening members.

6. A water heater, comprising:

a burner unit, having a first case and a burner, wherein a fuel gas is supplied into the first case, and the burner is installed to the first case and combusts the fuel gas;

a heat exchanger, having a second case and a heat transfer tube, wherein a combustion gas generated by the burner travels in the second case, and the heat transfer tube recovers heat from the combustion gas; and a first connection target part and a second connection target part, being frame-like parts provided at respective opening edge parts of the first case and the second case, and sandwiching a sealing member to face and be connected with each other, wherein an overall shape of the sealing member is in a frame shape corresponding to the first connection target part and the second connection target part, and a concave part that is notched or a hole part that is non-notched is formed at a portion of the sealing member, and a heat transfer convex part is provided in at least one of the first connection target part and the second connection target part, protrudes to enter the concave part or the hole part to be brought into surface contact with an other of the first connection target part and the second connection target part, and generates heat transfer between the first connection target part and the second connection target part, wherein the burner is installed to the first case by using a plurality of additional fastening members at a position on the inner side of the first connection target part in the first case, and at least a portion of an inner edge part of the sealing member is configured as an extension part protruding toward an inner side thereof from the first connection target part and the second connection target part and covering at least one of the additional fastening members.

7. The water heater as claimed in claim 6, wherein the heat transfer convex part is in a block shape or a rib shape extending in a same direction as the first connection target part and the second connection target part.

8. The water heater as claimed in claim 7, comprising: as the heat transfer convex part, a plurality of heat transfer convex parts arranged at intervals in a direction in which the first connection target part and the second connection target part extend, wherein a fastening part fastening the first connection target part and the second connection target part by using a fastening member is provided at a position between the heat transfer convex parts.

9. The water heater as claimed in claim 6, wherein the concave part or the hole part of the sealing member is formed on an outer edge of the sealing member or a portion near the outer edge, and the heat transfer convex part is located at a region near an outer side, which is a side away from the burner, in a region between the first connection target part and the second connection target part, and a portion of the sealing member is present on an inner side of the heat transfer convex part.

* * * * *